US005501134A

United States Patent [19]

Milazzo et al.

[11] Patent Number: 5,501,134

[45] Date of Patent: Mar. 26, 1996

[54] MULTI-STAGE MATCH TRIGGER ASSEMBLY FOR USE WITH SEMI-AUTOMATIC WEAPONS

[75] Inventors: Charles R. Milazzo, N9178 Walnut St., East Troy, Wis. 53120; John M. Krieger, Hartford, Wis.

[73] Assignee: Charles R. Milazzo, East Troy, Wis.

[21] Appl. No.: 299,854

[22] Filed: Sep. 1, 1994

Related U.S. Application Data

[63] Continuation of Ser. No. 37,791, Mar. 26, 1993, abandoned.

[51] Int. Cl.[6] ..... F41A 19/16

[52] U.S. Cl. ..... 89/139; 42/69.03

[58] Field of Search ..... 42/69.02, 69.03; 89/139, 140

[56] References Cited

U.S. PATENT DOCUMENTS

| | | | |
|---|---|---|---|
| 2,366,823 | 1/1945 | Williams | 89/139 |
| 2,399,253 | 4/1946 | Reilly | 89/139 |
| 2,590,862 | 4/1952 | Hoppert | 89/139 |
| 4,937,964 | 7/1990 | Crandall | 42/69.03 |
| 5,012,604 | 5/1991 | Rogers | 89/139 |

OTHER PUBLICATIONS

Smith, W. H. B, "Small Arms of the World", 1948 pp. 317–318.

Smith et al, "The Book of Rifles", 1948, pp. 464–466.

Smith et al, "Chamber", The Book of Rifles, 1948, p. 594.

*Primary Examiner*—Stephen C. Bentley

*Attorney, Agent, or Firm*—Wheeler & Kromholz

[57] ABSTRACT

A multi-stage trigger assembly for use by a shooter of a firearm. Specifically an AR-15 or M-16 although other types of firearms could be used. The invention comprises a trigger, a disconnector, disconnector spring, and a hammer. The trigger and the hammer each include a respective engagement means for engaging each other so that the hammer is held in a cocked position by the trigger before the trigger is pulled. The hammer further includes a contact means for contacting the disconnector so that when the trigger is first pulled (the first stage) the contact means contacts the disconnector at a predetermined time and increases the pressure required to pull the trigger completely and disengage the engagement means of the hammer and the trigger (the second stage). Additionally, the disconnector is spring loaded by the disconnector spring and pivotally connected to the trigger. This is so that the disconnector may interact with the hammer, which further includes a contact means for contacting the disconnector so that when the trigger is first pulled (the first stage) the contact means perceptibly contacts a cam like surface on the disconnector at a predetermined time where minimal engagement between the engagement means of the hammer and trigger is reached. The disconnector spring increases the pressure required to pull the trigger completely and disengage the engagement means of the hammer and the trigger (the second stage). This stop, or noticeable contact indicates to the shooter that the limited minimal engagement of the second stage has been reached.

8 Claims, 9 Drawing Sheets

MULTI-STAGE MATCH TRIGGER ASSEMBLY FOR USE WITH SEMI-AUTOMATIC WEAPONS

This application is a continuation of application Ser. No. 08/037,791 filed 26 Mar. 1993, now abandoned.

BACKGROUND OF THE INVENTION

The present invention relates generally to the field of trigger systems for semi-automatic weapons and specifically to the use of a trigger assembly on AR-15 type rifles; The AR-15 rifle is the civilian version of the military M-16 rifle and is sometimes referred to as the Mouse Gun.

The trigger assembly of the present invention is designed to help improve the accuracy and precision of the individual shooting a firearm by increasing the control that the individual (a shooter) has over trigger operation and thereby control over the discharge of the firearm. Control of the trigger operation is especially important in match shooting tournaments where the goal is to have better accuracy and precision than the other contestants. Total control over the operation of the trigger assembly, and thus the discharge of the firearm, is crucial.

Ideally the shooter wants to be able to discharge his or her firearm by exerting as little force as possible on the trigger so that there is minimal perceptible movement of the trigger. The more force and perceived motion required to pull or actuate the trigger, the harder it is to accurately hit the target since it is harder for the shooter to exactly determine when the firearm will discharge and also, since, a hard pull on the trigger tends to jar the whole firearm and thus affect the accuracy of the shooter.

In order to achieve this goal shooters desire to reduce the perceptible movement of the trigger to an absolute minimum point at which the gun will fire. Most shooters say they want a feel to the final pull of the trigger before firing that is similar to the breaking of a glass rod so that there is a crisp release as the firearm is discharged.

A smooth, almost effortless, pull of the trigger is desired since this will minimize any jarring of the firearm and makes it easy to determine the precise moment the firearm will discharge. In order to do this many match shooters will modify their trigger mechanisms to ensure that the mechanism is at absolute minimum engagement with the hammer of the firearm. This makes discharge of the firearm very easy. Unfortunately, this leads to a safety problem.

When the trigger mechanism has minimal engagement with the hammer it means that the firearm will readily discharge. Even the actions of carrying the firearm, of jarring the firearm, or the cycling action of the firearm after discharge could cause an unwanted discharge or an additional subsequent discharge. This, to put it mildly, is highly undesirable and creates a danger of serious injury or loss of life.

The present invention greatly reduces the probability of accidental firearm discharge while at the same time providing the firearm with desired trigger action characteristics. Shot to shot consistency of pull weight and travel is insured without abnormal manipulation or motion between shots. Also, the present invention makes the structure of the receiver of a semi-automatic weapon sufficiently different from the automatic weapons upon which the semi-automatic firearm is based so that it is much more difficult to convert the semi-automatic firearm to an automatic firearm.

While it is impossible to absolutely prevent a determined individual from illegally converting a semi-automatic firearm to an automatic firearm, the present invention makes it necessary for the person attempting the conversion to have a much greater level of skill to accomplish that conversion than is currently necessary.

The inventor knows of no prior art that discloses the unique and simple design of the present invention.

SUMMARY OF THE INVENTION

The invention may generally be described as a multi-stage trigger assembly for use by a shooter of a firearm; generally an AR-15 or M-16 although the invention could be used in other types of firearms and such use is contemplated by the inventor.

The multi-stage trigger assembly of the present invention comprises essentially a a trigger, a disconnector, a disconnector spring, and a hammer. The trigger is pivotally connected to the firearm and is typically spring loaded or tensioned in a known manner by a trigger return spring, as are the triggers of other firearms, so that the trigger is held in a predetermined position until it is pulled. The trigger spring thus establishes the initial amount of pull necessary to move the trigger and returns the trigger back to its normal position once the firearm has been discharged and the shooter has released the trigger. The trigger also has a pulling surface for allowing the shooter to pull or apply pressure to the trigger and thus actuate the mechanism of the present invention. The trigger and the hammer each include a respective engagement means for engaging each other so that the hammer is held in a cocked position by the trigger before the trigger is pulled. The hammer is also pivotally connected to the firearm and is spring actuated to strike the firing pin once it is released from its engagement with the trigger. It is the pulling of the trigger that releases the hammer.

The disconnector is spring loaded by the disconnector spring and pivotally connected to the trigger. This is so that the disconnector may interact with the hammer, which further includes a contact means for contacting the disconnector so that when the trigger is first pulled (the first stage) the contact means perceptibly contacts a cam like surface on the disconnector at a predetermined time where minimal engagement between the engagement means of the hammer and trigger is reached. The disconnector spring increases the pressure required to pull the trigger completely and disengage the engagement means of the hammer and the trigger (the second stage). This stop, or noticeable contact indicates to the shooter that the limited minimal engagement of the second stage has been reached.

Once the shooter feels the resistance or contact of the contact means contacting the disconnector he or she then knows that only slight additional pressure will be required to discharge the firearm. Accordingly, the shooter knows exactly when the firearm will discharge and thus can exert greater control over the accuracy of his or her shot and the precision with which that shot is made.

Releasing the trigger from its second stage engagement point will allow the trigger to return to its first stage engagement with no additional needed manipulation.

After the shooter discharges the firearm by releasing the hammer, the hammer strikes the firing pin of the firearm and is recocked by the known mechanism of the firearm in the normal manner except that the disconnector of the present invention will also have an engagement means for engaging an additional engagement surface on the hammer when the trigger is still depressed after a round has been discharged. This prevents accidental double discharge of the firearm.

The firearm cannot then be fired again until the shooter releases the trigger. The release of the trigger by the shooter, after a round has been discharged, causes the engagement means of the disconnector to disengage and the engagement means between the trigger and the hammer to re-engage so that the two stage process may again be repeated. The process of engagement, disengagement, and re-engagement occurs very quickly and does not slow down or interfere with the shooters ability to shoot but it does prevent accidental double discharge and increases the precision and accuracy of the shooter.

Also, the disconnector of the present invention may be modified so that in addition to being pivotally connected to the trigger and spring loaded it also has an adjustment means that allows the position of the disconnector, relative to its point of contact with the hammer of the firearm at the second stage of the firing process, be adjusted so that a point of absolute minimal engagement between the trigger and the hammer can reached. This fine adjustment feature allows the shooter to tailor the trigger action of the firearm to his or her individual needs and tastes.

Finally, the hammer of the present invention may be modified to have an additional engagement means so that at the trigger has been pulled and the firearm discharged the hammer will engage an engagement means on the disconnector and be held in place until the shooter releases the trigger and the firing sequence can be repeated.

These and other benefits of the present invention will be apparent to one skilled in the art from the following description.

DESCRIPTION OF THE DRAWINGS

FIG. 1 shows a cutaway side view of the prior art firearm with the hammer in the cocked position.

FIG. 2 shows a cutaway side view of the prior art firearm showing the hammer being released by the trigger and striking the firing pin.

FIG. 3 shows a cutaway side view of the prior art firearm with the bolt starting to move backwards and the hammer moving back toward the cocked position.

FIG. 4 shows a cutaway side view of the prior art firearm with the bolt back and the hammer returned to the cocked position and a new cartridge being placed into the chamber.

FIG. 5 shows a cutaway side view of the prior art firearm with the bolt starting to move forward.

FIG. 6 shows a cutaway side view of the prior art firearm with the bolt back in position and the trigger released.

FIG. 7 is a cutaway side view of the prior art firearm showing the relative movement of the hammer to the trigger.

FIG. 8 is a cutaway side view of the prior art firearm showing the firearm set to full automatic.

FIG. 9 is a side plan view of the firing mechanism of the present invention showing the engagement of the trigger and the hammer at the first firing stage.

FIG. 10 is a side plan view of the firing mechanism of the present invention showing the engagement of the trigger and the hammer at the second firing stage.

FIG. 11 is a side plan view of the firing mechanism of the present invention showing the engagement of the hammer and the disconnector after a round has been fired.

DETAILED DESCRIPTION

Figure 1:
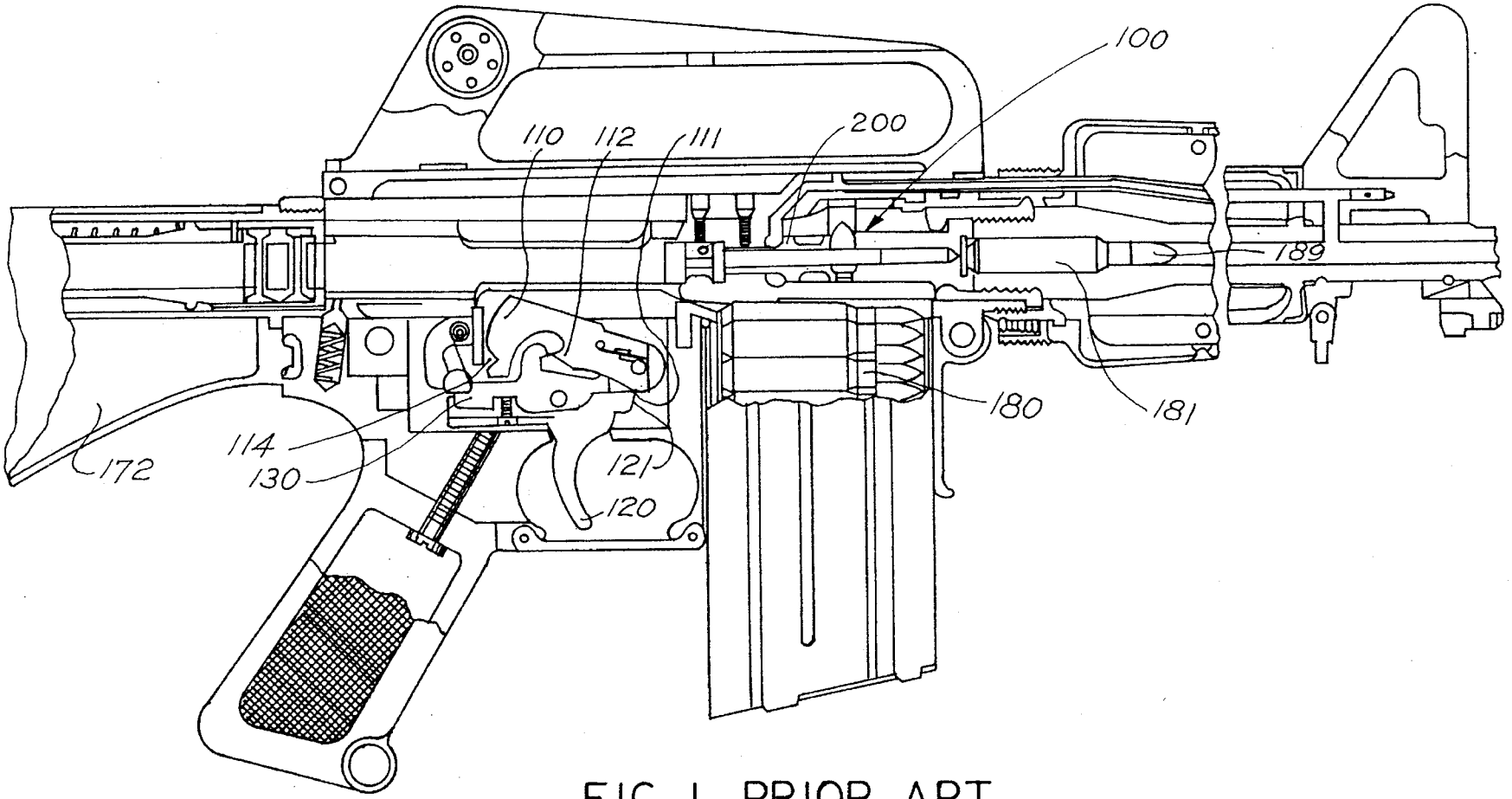
FIG. 1 PRIOR ART
FIGS. 1–8 are cutaway side views of the prior art trigger assembly of an AR-15/M-16 firearm.

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

The present invention 10 is specifically designed to work in combination with the civilian version of the M-16 known as the AR-15. However, the present invention 10 could be used with other types of firearms having characteristics similar to the AR-15.

To understand the function and structure of the present invention it is necessary to understand how the AR-15 functions. Referring to FIGS. 1–8 the firing action of the AR-15, set on semi-automatic, may be explained.

As illustrated in FIG. 1–8 the firing mechanism assembly 100 of the AR-15 may be seen to include a hammer 110, a lower hammer notch 111, an upper hammer notch 112, hammer springs 113, a top outside hammer notch 114, a trigger 120, a trigger sear 121, a trigger pin 122, a trigger spring 123, a disconnect mechanism 130, a disconnect hook 131, a disconnect spring 132, a bolt 140, a bolt carrier 141, a bolt carrier key 142, a firing pin 151 having a base 150 and a head 152, a gas tube 160, a gas tube port 161, a buffer assembly 170, an action spring 171, a buffer 174, cartridges 180, and a spring loaded magazine 190 for holding the cartridges 180.

Figure 2:
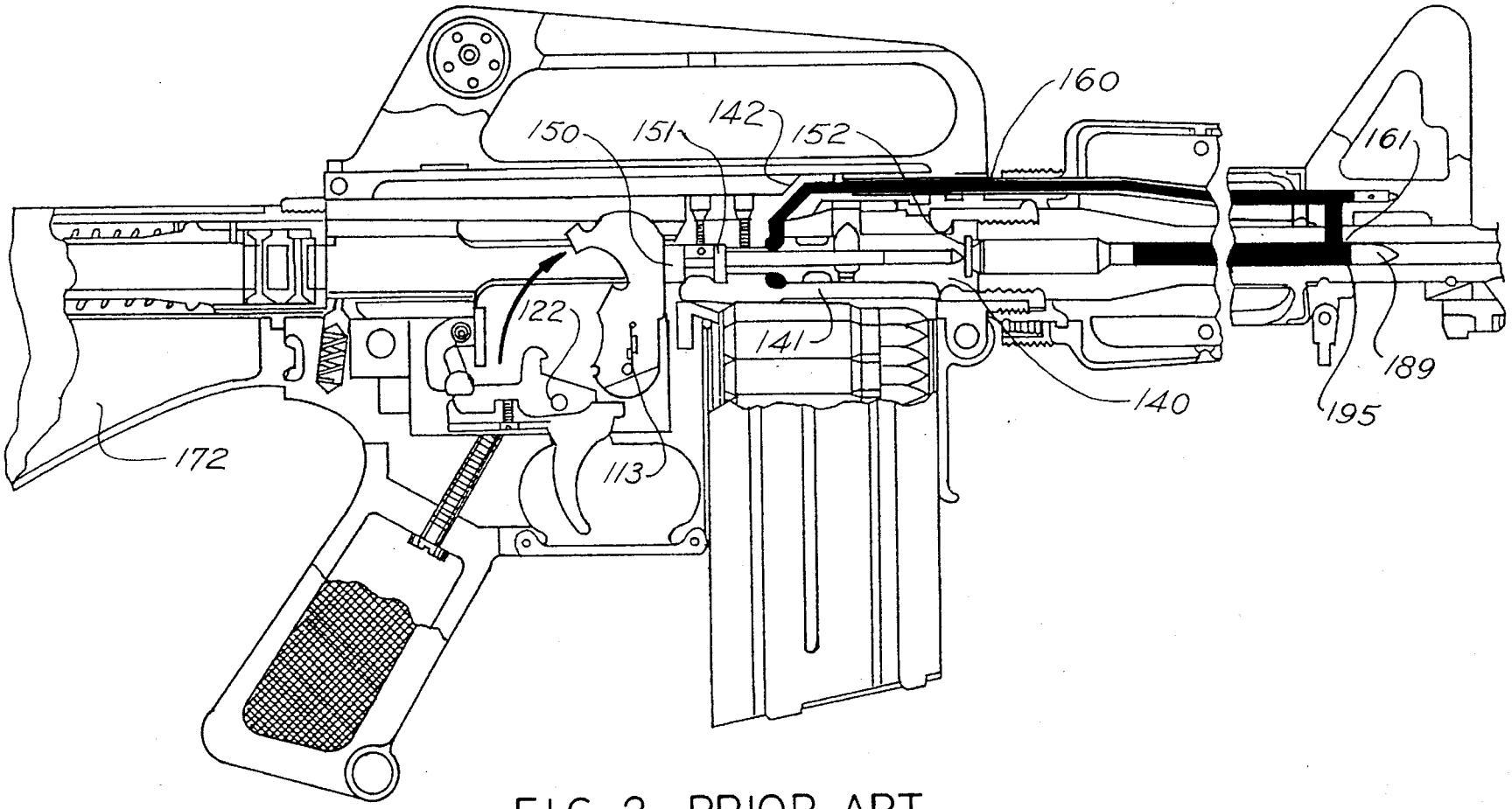
FIG. 2 PRIOR ART

As FIGS. 1 and 2 illustrate, the firing process of the AR-15 begins with the hammer notch 111 engaged with the trigger sear 121. As the trigger 120 is pulled, the hammer 110 is released and rotates forward, striking the firing pin 151 on its base 150 and firing the chambered cartridge 181 thereby discharging a bullet 189 from the barrel 195. As the bullet 189 passes the gas port 161, a portion of the expanding gas that propels the bullet 189 is routed from the barrel 195 through the gas tube 160 and into a cylinder 200 formed between the bolt 140 and the bolt carrier 141.

Figure 3:
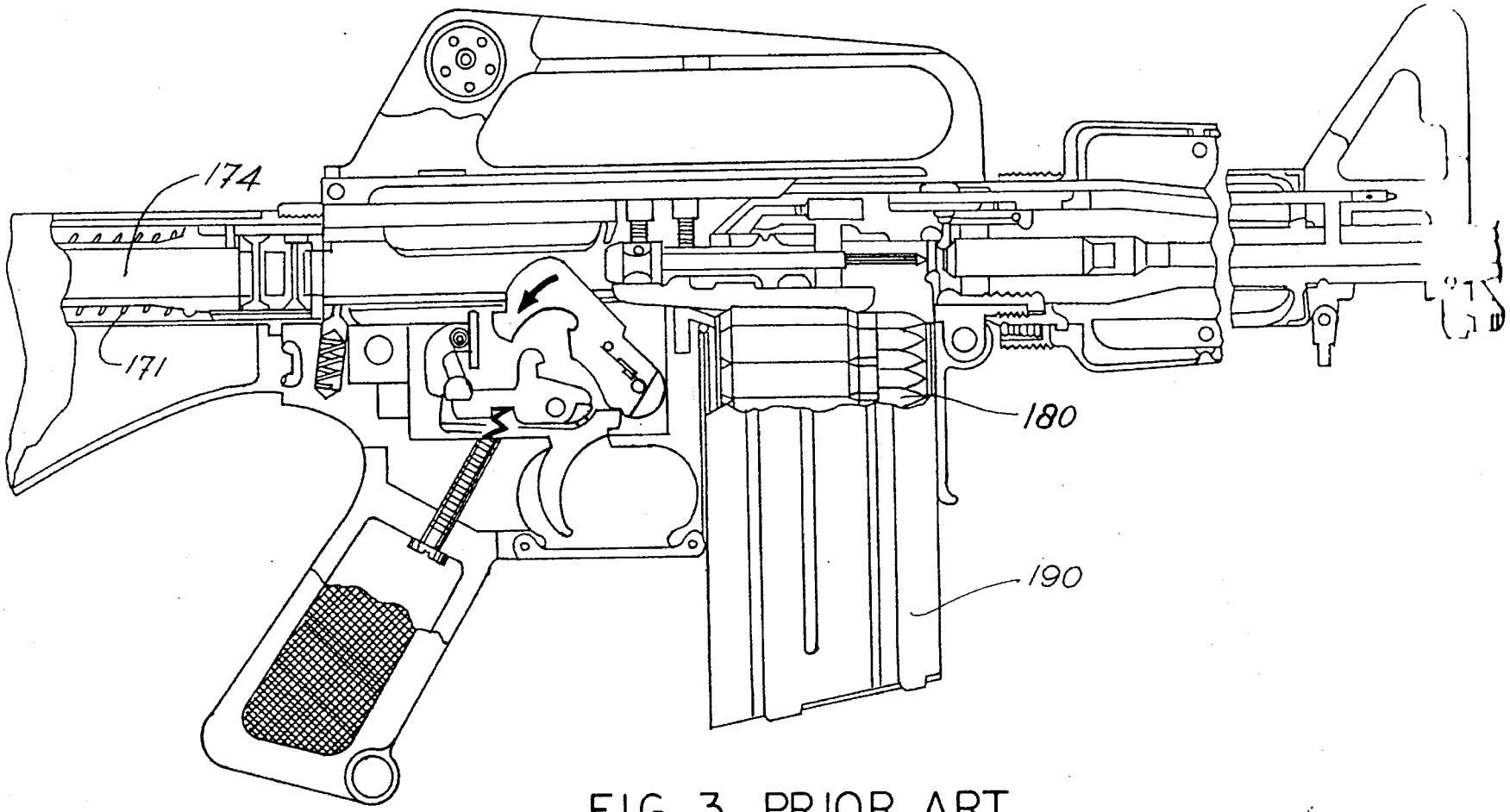
FIG. 3 PRIOR ART

Referring to FIG. 3, the pressure of the gas diverted into the cylinder 200 is sufficient to drive the bolt carrier 141 toward the buffer 174 located in the stock 172 of the AR-15. As this happens the bolt cam pin rotates the bolt 140 and disengages the bolt lugs from the lugs in the barrel extension. The hammer 110 is thereby returned to its cocked position and the action spring 171 is compressed. As the bolt 140 and bolt carrier 141 move rearward, the extractor withdraws the spent cartridge case from the chamber, and the ejector throws it out the ejection port.

Figure 4:
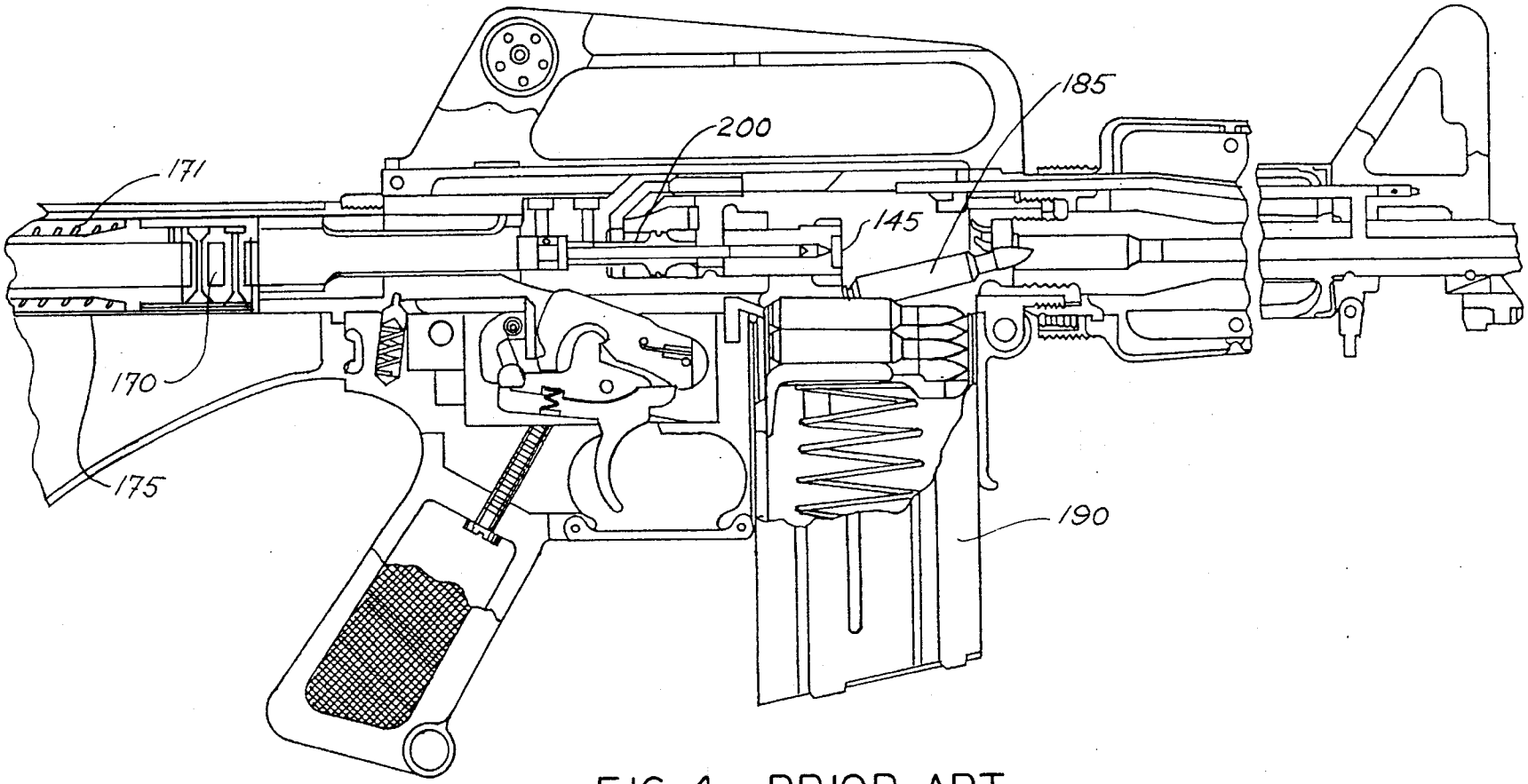
FIG. 4 PRIOR ART
Figure 5:
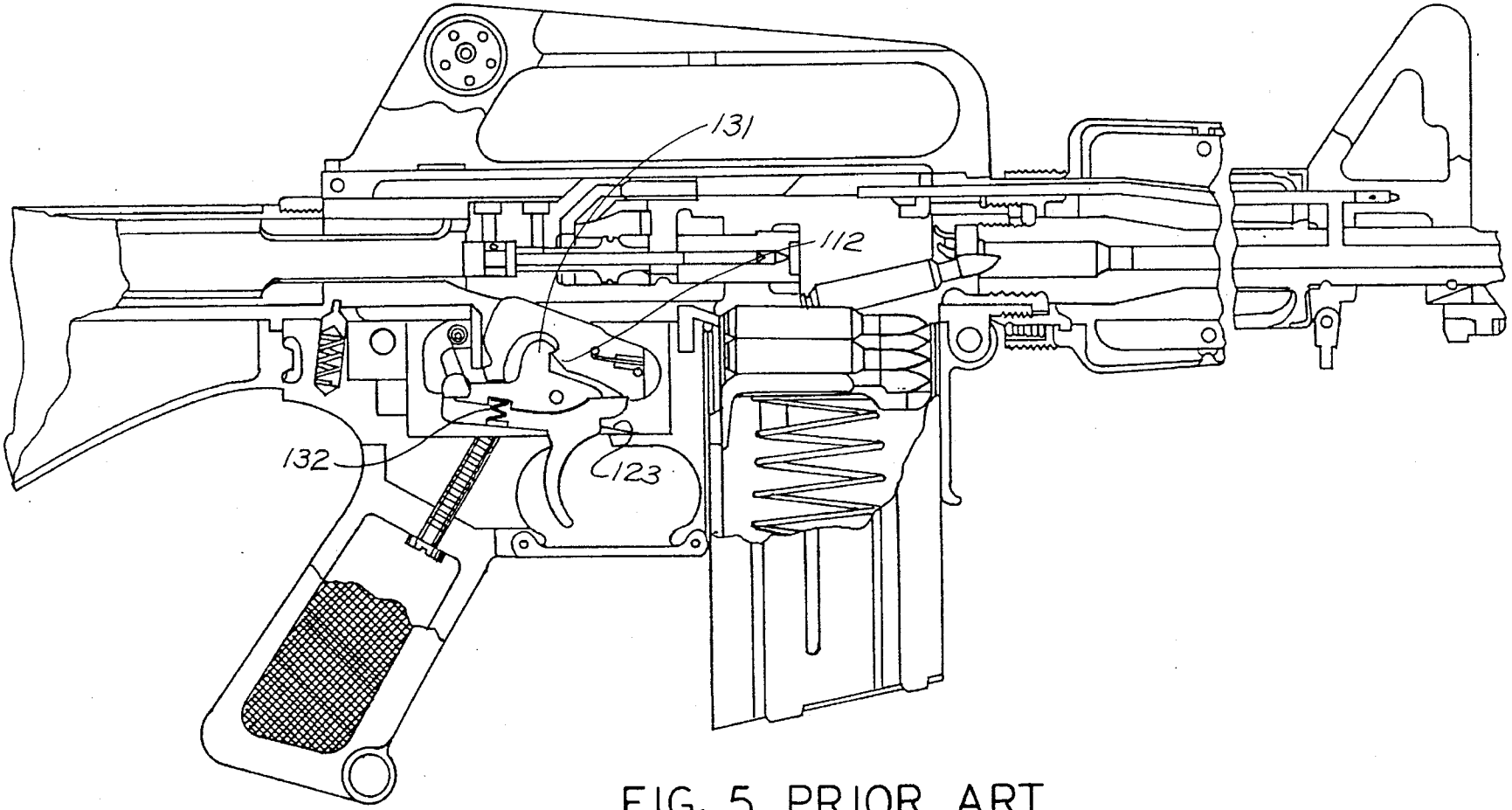
FIG. 5 PRIOR ART
Figure 6:
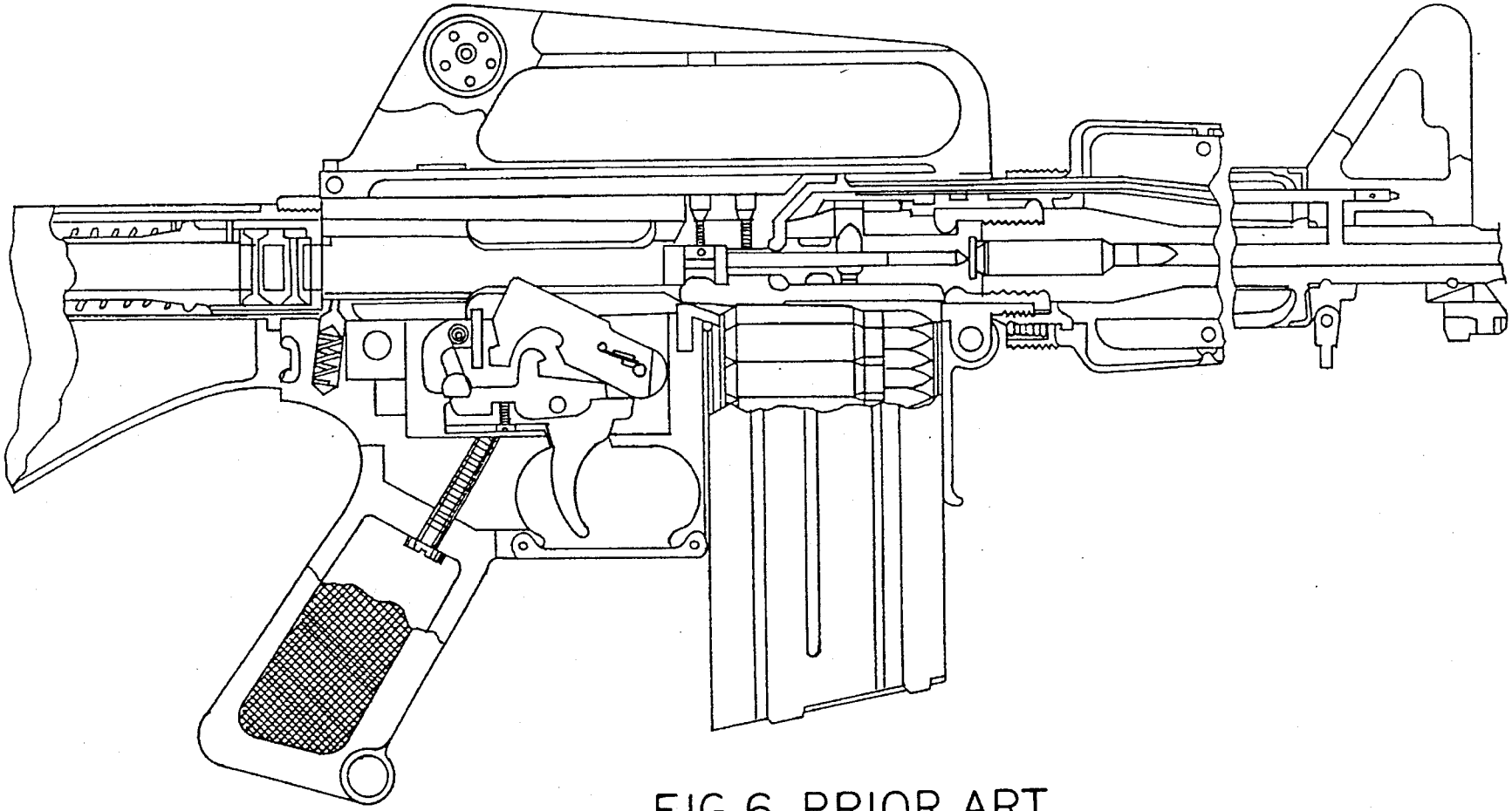
FIG.6 PRIOR ART
Figure 7:
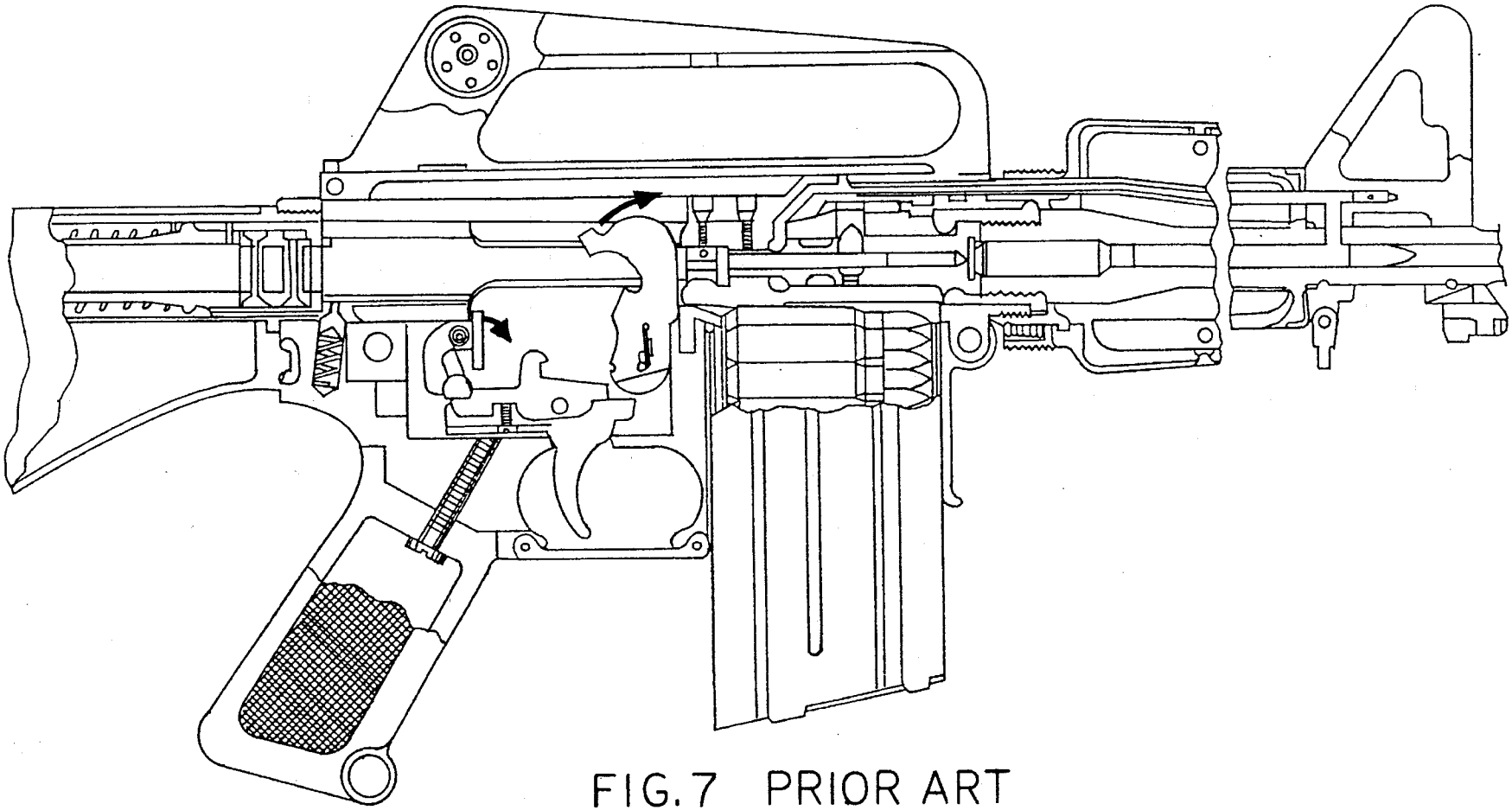
FIG. 7 PRIOR ART
Figure 8:
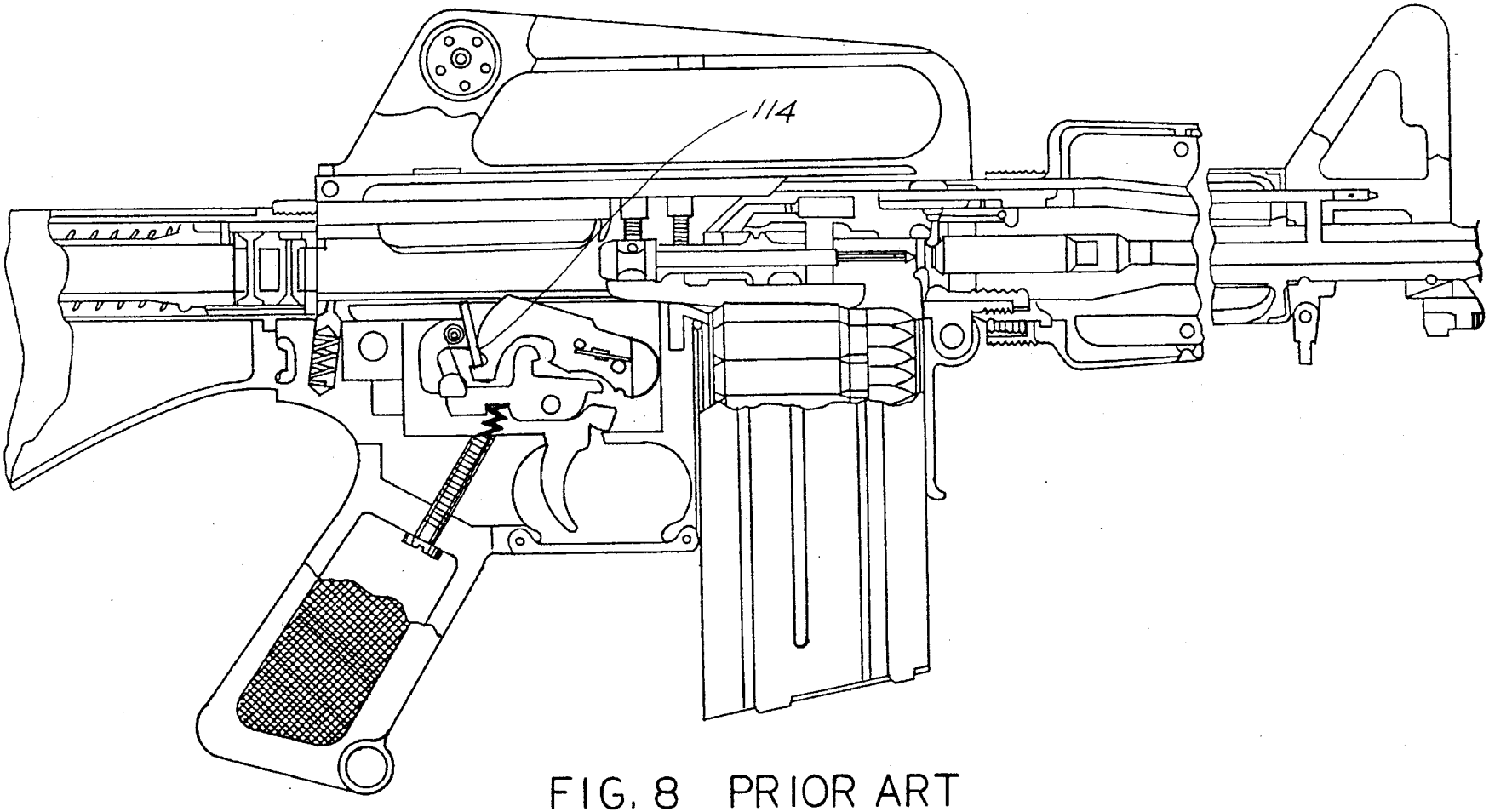
FIG. 8 PRIOR ART

Looking at FIG. 4, the rearward motion of the bolt carrier 141 may be seen to be arrested by the buffer assembly 170 in the action spring guide 175. The compressed action spring 171 then forces the bolt carrier 141 forward. The face 145 of the bolt 140 picks up the top cartridge 185 from the magazine 190 and thrusts it into the barrel 195.

Referring to FIGS. 5–8, as the bolt lugs enter the barrel extension, the ejector is depressed against the cartridge case and the extractor snaps into the extracting groove. During the final half inch of the closing stroke, the bolt cam pin moves out of the receiver guide and rotates the bolt 140 to the locked position. The upper hammer notch 112 is held by the hook 131 of the disconnect 130. When the trigger 120 is released, the trigger spring 123 causes the trigger 120 to return to its normal position, carrying the disconnect 130 backward, releasing the hammer 110, which drops from the disconnect 130 to the cocked position on the trigger sear 121.

Figure 9:
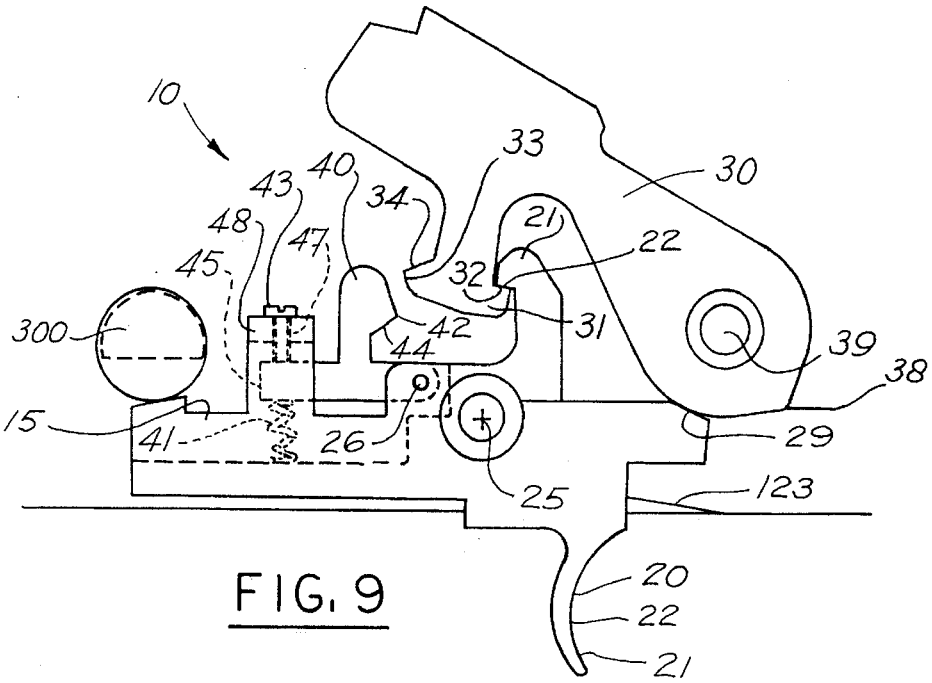
FIGS. 9–11 show the two stage trigger assembly of the present invention.
Figure 10:
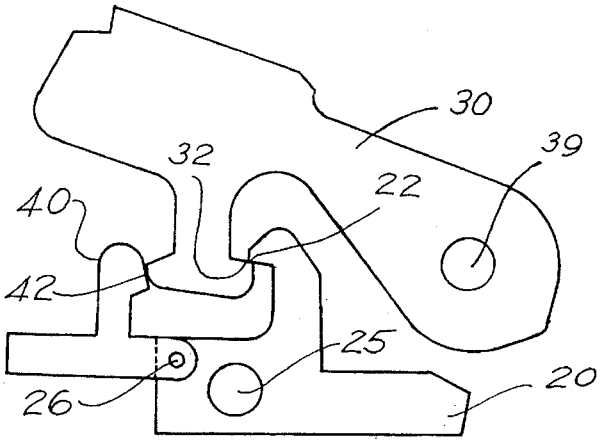
Figure 11:
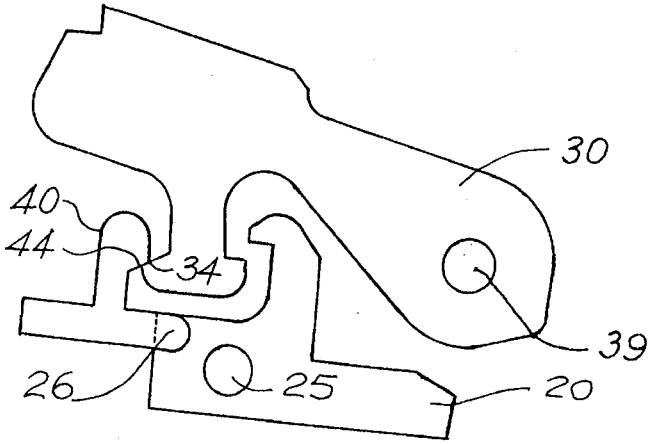

The present invention 10 eliminates the single stage trigger structure of the AR-15 and replaces it with a two stage structure that is mounted in the receiver 15 of the AR-15; shown in FIGS. 9–11.

The present invention 10 may be seen to comprise a trigger 20, a trigger hook 21, a hammer 30, a hammer hook 31 integral to the hammer 30, and a adjustable disconnector 40 having a disconnector spring 41 and an adjustment screw 43.

The trigger hook 21 has an engagement surface 22. The hammer hook 31 has an engagement surface 32. In the first stage before pulling the trigger 20 it is desirable to make the contact area between these two surfaces (21 and 32) as large as possible. This prevents accidental discharge of the firearm 11. The trigger hook 21 and the disconnector 40 are directly connected to the trigger 20 so that the trigger hook 21, the disconnector 40, and the trigger 20 pivot about pivot pin 25.

The disconnector 40 has a disconnector cam surface 42 and the hammer 30 has a hammer cam surface 33. As shown in FIG. 9, disconnector cam surface 42 is flat and not concave. Referring to FIG. 10, as the trigger 20 is pulled the trigger hook 21, the disconnector 40, and the trigger 20 pivot about pivot pin 25 so that the hammer cam surface 33 contacts flat the disconnector cam surface 42 and the contact area between engagement surface 22 and engagement surface 32 is reduced to the minimum necessary to prevent the hammer hook 31 from being released. This is the movement from the first stage to the second stage of the two stage trigger assembly of the present invention 10.

The contact of the disconnector cam surface 42 and the hammer cam surface 33 provides an increase in the resistance to the pull of the trigger 20. Typically, a firearm will have a certain predetermined amount of pull weight required to actuate the trigger mechanism and discharges the firearm. In the present invention 10 this pull weight is about 3 to 4 pounds of total force; 1 to 2 pounds in the initial or first stage and 1 to 2 additional pounds in the final or second stage. The amount of pull weight may, of course, be adjusted using different springs or adjusting the tension of the springs already in the firearm.

Prior to firing a shooter will want to feel a distinct and discernable contact or stop in the movement of the trigger. This contact is the limiting factor for second stage. This perceived stop acts to inform the shooter that only a slight augmentation of the pressure being applied to the trigger will now produce the crisp action that will immediately result in discharge of the firearm. The shooter may then apply that pressure and immediately discharge the firearm in a precise and accurate manner.

Accordingly, in order that this type of feel be achieved the contact area between the engagement surfaces 22 and 32 in the first stage may be kept at a maximum. As the trigger is pulled and the stop point is reached due to contact between the hammer cam surface 33 and the disconnector cam surface 42, the contact area between the engagement surfaces 22 and 32 is reduced to a minimum; typically about 0.005 inches.

The shootor feeling this clearly discernable stop may then accurately and safely pull the trigger 20 to completion. The hammer 30 then contacts the rest of the firing mechanism of the AR-15 as previously described except that if the trigger 20 of the two stage trigger mechanism of the present invention 10 is kept compressed the hammer hook 34 will engage the disconnector hook 44 thereby preventing an accidental or double discharge of the firearm. This is shown in FIG. 11.

This engagement of the hammer hook 34 and the disconnector hook 44 after discharge of the firearm is made possible by the structure of the disconnector 40.

Still referring to FIGS. 9–11 and in particular FIG. 9, the disconnector 40 may be seen to be a separate structure from the trigger 20. It is connected to the trigger 20 by and at pivot pin 26. The disconnector 40 further includes the adjustment screw 43 and the spring 41. Located between the screw 43 and the spring 41 is the adjustment arm 45 of the disconnector 40. The adjustment screw 43 serves two functions. First, it adjusts the point of second stage engagement, i.e. the point where the hammer contact surface 33 contacts the flat disconnector cam surface 42. Second, the adjustment screw 43 adjusts the tension in spring 41 and thus sets the tension required to discharge the firearm.

The spring 41 is located between the adjustment arm 45 and the body of the receiver 15. The screw 43 is mounted, through a threaded opening 47 in a block 48 mounted to the receiver 15, above the adjustment arm 45. Turning the screw 43 so that it moves downward against the adjustment arm 45 will move the adjustment arm 45 downward so that the spring 41 is compressed. Loosening the screw 43 will cause the screw 43 to move away from the adjustment arm 45 and the compressed spring 41 will move the adjustment arm 45 upward.

Consequently, as illustrated by FIGS. 9–11, the movement of the adjustment arm 45 affects the position of the flat disconnector cam surface 42 so that the point of contact between the flat disconnector cam surface 42 and the hammer cam surface 33 can be fine tuned for maximum effect and reliability. Once the relationship between the disconnector cam surface 42 and the hammer cam surface 33 is made no further adjustment of the adjustment arm 45 is necessary nor should it be necessary; other than to compensate for the normal wear of the parts over time.

Please note that while the relationship between the disconnector cam surface 42 and the hammer cam surface 33 may be finely adjusted by using the screw 43 to move the adjustment arm 45 no adjustment means is necessary and that all points of engagement and contact within the present invention 10 could be pre-set at the manufacturer. Finally, the hammer hook 34 and the disconnector hook 44 will engage with each other immediately after the trigger 20 has been pulled and the firearm discharged. This prevents the hammer 30 from being able to rotate back up and strike the firing pin 151 again after discharge while the trigger 20 is still totally depressed or pulled. This prevents the inadvertent automatic or double discharge firing of the firearm.

The hammer 30 is locked in position and another bullet 189 cannot be discharged from the firearm until the trigger 20 has been released so that the firing process may be repeated.

Finally, the present invention 10 may also include a trigger return blocking cam 38 on the hammer 30 and a trigger limit pad 29 on the trigger 20 as shown in FIG. 9–11. This eliminates the notch 111. The trigger return blocking cam 38 and the trigger limit pad 29 eliminate the possibility of engagement of the safety 300 when the hammer 30 is in the fired position. This prevents the possibility of damaging the mechanism of the present invention 10.

The foregoing is considered as illustrative only of the principles of the invention. Furthermore, since numerous modifications and changes will readily occur to those skilled in the art, it is not desired to limit the invention to the exact construction and operation shown and described.

What is claimed is:

1. A multi-stage trigger assembly for use by a shooter of a fire arm, the multi-stage trigger assembly comprising:

a trigger, a disconnector and a hammer;

the trigger being pivotally connected to the fire arm and to the disconnector;

the trigger further having a tensioning means for setting an initial trigger tension and holding the trigger in a normal position;

the hammer being pivotally connected to the fire arm;

the trigger having a pulling surface for the shooter to pull the trigger and the trigger and hammer each including a respective engagement means for engaging each other so that the hammer is held in a cocked position before the trigger is pulled;

the disconnector being pivotally connected to the trigger, the disconnector having a flat contact means and having a disconnector spring for holding the disconnector in a predetermined position until a sufficient force is applied to overcome the resistance of the disconnector spring;

the hammer further including a contact means for contacting the disconnector contact means so that when the trigger is first pulled the contact means contacts the disconnector and increases the pressure required to pull the trigger completely and disengage the engagement means of the hammer and the trigger;

the disconnector further including a disconnector adjustment arm and an adjustment screw;

the disconnector spring being located between the disconnector adjustment arm and the trigger.

2. A multi-stage trigger assembly for use by a shooter of a fire arm, the multi-stage trigger assembly comprising:

a trigger, a disconnector and a hammer;

the trigger being pivotally connected to the fire arm and to the disconnector;

the trigger further having a trigger spring for setting an initial trigger tension and holding the trigger in a normal position;

the hammer being pivotally connected to the fire arm;

the trigger having a pulling surface for the shooter to pull the trigger and the trigger and hammer each including a trigger hook and hammer hook respectively for engaging each other so that the hammer is held in a cocked position before the trigger is pulled;

the disconnector being pivotally connected to the trigger and having a flat disconnector cam surface and a disconnector adjustment arm;

a disconnector spring for holding the disconnector in a predetermined position until a sufficient force is applied to overcome the resistance of the disconnector spring;

the hammer further including a hammer cam surface for contacting the disconnector cam surface so that when the trigger is first pulled the hammer cam surface contacts the disconnector cam surface and increases the pressure required to pull the trigger completely and disengage the engaged hammer hook and trigger hook;

the disconnector spring having a first and a second end;

the first end of the disconnector spring contacting the trigger;

the second end of the disconnector spring contacting the disconnector adjustment arm;

the disconnector further including an adjustment screw for adjusting the pressure required to pull the trigger completely and for adjusting the position of the contact means of the disconnector cam surface relative to the hammer cam surface.

3. The multi-stage trigger assembly of claim 2 in which the disconnector further includes a disconnector hook for engaging a second hammer hook on the hammer after the trigger has been pulled and the fire arm discharged.

4. A multi-stage trigger assembly for use by a shooter of a rifle, the multi-stage trigger assembly comprising:

a trigger, a disconnector and a hammer;

the trigger being pivotally connected to the fire arm and to the disconnector;

the trigger further having a tensioning means for setting an initial trigger tension and holding the trigger in a normal position;

the hammer being pivotally connected to the fire arm;

the trigger having a pulling surface for the shooter to pull the trigger and the trigger and hammer each including a respective engagement means for engaging each other so that the hammer is held in a cocked position before the trigger is pulled;

the disconnector being pivotally connected to the trigger, the disconnector having a flat contact means and having a disconnector spring for holding the disconnector in a predetermined position until a sufficient force is applied to overcome the resistance of the disconnector spring;

the hammer further including a contact means for contacting the disconnector contact means so that when the trigger is first pulled the contact means contacts the disconnector and increases the pressure required to pull the trigger completely and disengage the engagement means of the hammer and the trigger;

the disconnector further including a disconnector adjustment arm and an adjustment screw;

the disconnector spring being located between the disconnector adjustment arm and the trigger;

the screw being rotatable for adjusting the position of the contact means of the disconnector relative to the contact means of the hammer and the tension of the disconnector spring;

the disconnector further including an engagement means for engaging a second engagement means on the hammer after the trigger has been pulled and the fire arm discharged.

5. The multi-stage trigger assembly of claim 4 in which the disconnector further includes a disconnector hook for engaging a second hammer hook on the hammer after the trigger has been pulled and the rifle discharged.

6. A multi-stage trigger assembly for use by a shooter of a rifle, the multi-stage trigger assembly comprising:

a trigger, a disconnector and a hammer;

the trigger being pivotally connected to the fire arm and to the disconnector;

the trigger further having a trigger spring for setting an initial trigger tension and holding the trigger in a normal position;

the hammer being pivotally connected to the fire arm;

the trigger having a pulling surface for the shooter to pull the trigger and the trigger and hammer each including a trigger hook and hammer hook respectively for engaging each other so that the hammer is held in a cocked position before the trigger is pulled;

the disconnector being pivotally connected to the trigger and having a flat disconnector cam surface and a disconnector adjustment arm;

a disconnector spring for holding the disconnector in a predetermined position until a sufficient force is applied to overcome the resistance of the disconnector spring;

the hammer further including a hammer cam surface for contacting the disconnector cam surface so that when the trigger is first pulled the hammer cam surface contacts the disconnector cam surface and increases the pressure required to pull the trigger completely and disengage the engaged hammer hook and trigger hook;

the disconnector spring being located between the disconnector adjustment arm and the trigger;

the disconnector further including an adjustment screw for adjusting the pressure required to pull the trigger completely and for adjusting the position of the contact means of the disconnector cam surface relative to the hammer cam surface.

7. An improved multi-stage trigger assembly for a fire arm of the type having a trigger pivotally connected to the fire arm, the trigger further having a trigger spring, a hammer pivotally connected to the fire arm, and a disconnector pivotally connected to the trigger, wherein the improvement comprises:

an adjustment screw having an end, the adjustment screw threadedly engaged within the trigger;

the disconnector including a disconnector adjustment arm;

a disconnector spring being located between the disconnector adjustment arm and the trigger.

8. An improved multi-stage trigger assembly for a fire arm of the type having a trigger, a disconnector, and a hammer, the trigger being pivotally connected to the fire arm and to the disconnector, the trigger further having a trigger spring for setting an initial trigger tension and holding the trigger in a normal position, the hammer being pivotally connected to the fire arm, the trigger having a pulling surface for the shooter to pull the trigger and the trigger and hammer each including a respective engagement means for engaging each other so that the hammer is held in a cocked position before the trigger is pulled, the disconnector being pivotally connected to the trigger, the disconnector having a flat disconnector means, the hammer further including a contact means for contacting the disconnector contact means so that when the trigger is first pulled the contact means contacts the disconnector and increases the pressure required to pull the trigger completely and disengage the engagement means of the hammer and the trigger, wherein the improvement comprises:

an adjustment screw having an end, the adjustment screw threadedly engaged within the trigger;

the disconnector including a disconnector adjustment arm;

a disconnector spring being located between the disconnector adjustment arm and the trigger.

* * * * *